US005110417A

United States Patent [19]

Lehtonen et al.

[11] Patent Number: 5,110,417

[45] Date of Patent: May 5, 1992

[54] EXTENDED PRESS ZONE WITH SHALLOW HYDRODYNAMIC POCKET

[75] Inventors: Jarmo Lehtonen; Jukka Kinnunen, both of Tampere, Finland

[73] Assignee: OY Tampella AB, Tampere, Finland

[21] Appl. No.: 628,014

[22] Filed: Dec. 17, 1990

[30] Foreign Application Priority Data

Dec. 21, 1989 [FI] Finland ..... 896163

[51] Int. Cl.[5] ..... D21F 3/06

[52] U.S. Cl. ..... 162/358; 100/154; 162/205; 162/361

[58] Field of Search ..... 162/205, 305, 358, 360.1, 162/361; 100/153, 154, 118, 121

[56] References Cited

U.S. PATENT DOCUMENTS

| | | | |
|---|---|---|---|
| 4,518,460 | 5/1985 | Hauser et al. | 162/358 |
| 4,568,423 | 2/1986 | Laapotti | 162/358 |
| 4,570,314 | 2/1986 | Holik et al. | 162/358 |
| 4,661,206 | 4/1987 | Heitmann et al. | 162/358 |
| 4,917,767 | 4/1990 | Ilmarinen et al. | 162/358 |

FOREIGN PATENT DOCUMENTS

| | | |
|---|---|---|
| 3408119 | 8/1985 | Fed. Rep. of Germany . |
| 78941 | 6/1989 | Finland . |
| 892518 | 11/1989 | Finland . |
| 2029471 | 3/1980 | United Kingdom . |
| 2182367 | 5/1987 | United Kingdom . |

*Primary Examiner*—Karen M. Hastings

*Attorney, Agent, or Firm*—Banner, Birch, McKie & Beckett

[57] ABSTRACT

A press with extended press zone in a paper machine comprising a rotating press roll (1), a press shoe (2), and a slide band (7) sliding along the surface of the press shoe, a web (6) being passed between felts (4, 5) through the press, where it is pressed between the roll (1) and the slide band (7). The press shoe (2), designed to operate hydrodynamically, has a surface provided with a pocket area (d) formed by one or more pockets of small average thickness. If required, pressurized lubricant can be introduced to the pocket area to achieve the desired press effect and speed.

19 Claims, 3 Drawing Sheets

EXTENDED PRESS ZONE WITH SHALLOW HYDRODYNAMIC POCKET

This invention relates to a press with extended press zone in a paper machine for dewatering a wet fibre web, comprising a rotating press roll and at least one press shoe extending in the axial direction of the press roll, said press shoe bearing on the press roll;

a liquid-impermeable slide band sliding along the surface of the press shoe between the press shoe and the press roll in the direction of travel of the fibre web;

means for introducing lubricant between the slide band and the press shoe at its entry edge; and at least one press felt for passing the fibre web through the press between the press roll and the slide band and for receiving water from the fibre web.

In the production of paper and paper board, the flow of liquid is restricted in certain types of paper and board during the wet pressing step. In such cases, the removal of water in the nip can be made more effective by increasing the length of the press zone. With roll presses, this is achieved by increasing the diameter of the press rolls and by coating the rolls with a soft material. In addition, high line loads are applied, so that the length of the press zone is increased up to 100 mm, whereby such factors as excessive masses and the durability of the coating become restrictive. As compared with roll presses, a substantially longer press zone is achieved by so-called shoe presses in which one roll in the roll press is replaced with a stationary concave press shoe bearing on the rotating press roll. The felts and the fibre web are passed through the nip between the roll and an elastic band sliding along the press shoe. In addition to the longer press zone, typically about 250 mm, the shoe press also causes the pressure to be distributed more evenly over the length of the nip. As a result, considerably higher line loads than in roll presses can be applied in shoe presses without that the maximum pressure rises excessively in any point. Technically, shoe presses can be divided into two groups on the basis of the lubrication mechanism of the band sliding along the shoe, viz. into hydrodynamic and hydrostatic presses.

Shoe presses based on hydrodynamic lubrication are described in U.S. Reissue Pat. No. 30268 and U.S. Pat. No. 4,427,492, for instance. Both of these disclose a solution in which lubricant is introduced between the band and the shoe on the entry side of the band sliding along the shoe at the front edge of the shoe. The lubricant flows with the band between the band and the shoe, thus forming a wedge-shaped lubrication film on the surface of the shoe and the band. The bearing capacity of the lubrication film depends on the speed of the band with respect to the shoe, and it disappears totally when the speed approaches zero. When selecting the viscosity of the lubricant, it has to be taken into account that it might be necessary to operate the press at speeds below the design value or at load pressures exceeding the design values. In practice, this means that the viscosity is overdimensioned, as a result of which the friction losses caused by the shearing of the lubricant will be considerably greater than actually needed. For the same reasons, the shoe press based on hydrodynamic lubrication is not particularly suitable for use when a wide speed and load range is required from the press.

In the hydrostatic shoe press, disclosed, e.g., in U.S. Pat. Nos. 3,853,698, 4,427,492, 4,570,314 and 4,568,423, the bearing capacity is achieved mainly by introducing pressurized lubricant through the shoe between the band and the shoe, so that the lubricant presses the band against the roll and lubricates the contact surfaces between the band and shoe as it is squeezed out through the edges. With hydrostatic lubrication, the load and the bearing capacity of the shoe disappears if the flow of pressurized lubricant is interrupted for one reason or another. The lubricant is typically introduced into deep elongated pockets provided in the surface of the press shoe in usually the axial direction of the counter roll. In the area of the pockets the band is loaded solely hydrostatically as no hydrodynamic lubricant wedge with increasing pressure is formed therein. Accordingly, the pressure exerted on the band in the area of the pockets is constant, and the power required for pumping the lubricant into the pocket is substantially dependent on the desired thickness of the lubrication film and the length of the entry and delivery edges acting as sealing edges in the direction of travel of the band. When low pumping losses are aimed at, the film should be thin and the sealing edges should be long. As compared with the hydrodynamic shoe, an advantage of the hydrostatic shoe is that it provides a wider range of operation as the hydrostatic pressure to be applied can be varied. On the other hand, a disadvantage is the resulting greater total power consumption and greater costs.

Distribution of pressure in the nip affects greatly the properties of the paper or board. If the compression pressure at the beginning of the press zone increases too rapidly, an excessive hydraulic pressure created in the web may cause water to flow in the direction of the web, thus impairing the strength properties of the paper as the formation of bonds between the fibres is hampered. Optimally, the compression pressure increases evenly over the length of the press zone and reaches its maximum immediately before the end of the nip. A gradually decreasing compression pressure creates an underpressure in the web, which causes part of the removed water to return to the web from the felt, thus rewetting the web.

Another essential factor affecting the properties of the resulting paper or board is the maximum pressure created in the nip, which must be on the right level both in view of the properties of the web and the operability of the felts to optimize the strength properties of the paper and to achieve high content of dry substance. With the roll press, the maximum pressure can be determined by calculation on the basis of the roll diameters and the compressibility of the coatings and the press felts. The compressibility of the felts, in turn, can be affected by selecting a basic fabric best suited for the press felt. Variation in the properties of the felts during operation nevertheless causes problems. When the felts wear, they get considerably thinner, which results in an increase in the maximum pressure in the nip. Impaired operating properties of the felts, in turn, make it necessary to decrease the line load of the press to keep the maximum pressure on the desired level. As a result, the dry substance content of the web decreases after the press as it is directly dependent on the pressure impulse created in the press.

It is typical of the pressure distribution in hydrodynamic shoe presses that the pressure increases at the beginning of the nip and the maximum value is achieved after the point of support of the shoe. The pressure distribution can be affected to some extent by suitably shaping the shoe, and the position of the maximum pressure can be affected to some extent by displacing the centre of gravity of the supporting force. The pressure drop on the delivery edge of the hydrodynamic shoe is, however, relatively gradual. The maximum pressure of hydrodynamic shoe presses can be varied only by varying the line load of the presses, as a result of which the pressure impulse changes, which, in turn, causes variation in the dry substance content of the web emerging from the press. In the hydrostatic shoe press, the pressure in the area of the pocket is constant, and the pressure variations at the beginning of the nip and correspondingly in the end depend on the length of the sealing edges on the entry and delivery side. With short sealing edges, the pressure is substantially constant over the whole press zone. As a result of this, however, the pressure rises relatively abruptly on the entry side, which may cause water flows in the longitudinal direction of the web. By using several successive pockets and by dimensioning the lengths of the entry and delivery edges in different ways, the pressure distribution can be affected to some extent; however, the pressure is still constant at each pocket and the pressure changes gradually.

The object of the present invention is to provide a compression shoe which provides a wide range of operation with respect to both the speed of the web and the load, and by means of which a desired press effect can be achieved in all operation conditions with the smallest possible consumption of energy. This is achieved according to the invention in such a manner that in the press shoe a surface facing the slide band comprises a pocket area having at least substantially the same width as the fibre web and being narrower than the press zone in the direction of travel of the band, said pocket area comprising at least one pocket formed in the surface of the press shoe as a recess;

the press comprises at least one lubrication conduit for introducing pressurized lubricant to the pocket area; and the depth of the pockets in the pocket area is such that the press operates substantially hydrodynamically above a predetermined web speed.

The basic idea of the invention is that the hydrodynamically operated shoe is provided with a pocket area comprising one or more pockets the average depth of which is no more than 0.75 mm, pressurized lubricant being introduced into the pockets. In this way the shoe operates solely hydrodynamically above a predetermined web speed and the influence of the hydrostatic pressure is increased above this speed without losing the hydrodynamic formation of pressure and, as a consequence, the pressure increasing over the entire length of the pocket area.

BRIEF DESCRIPTION OF THE DRAWINGS

The invention will, be described in greater detail in the attached drawings, where.

DETAILED DESCRIPTION

Figure 1:
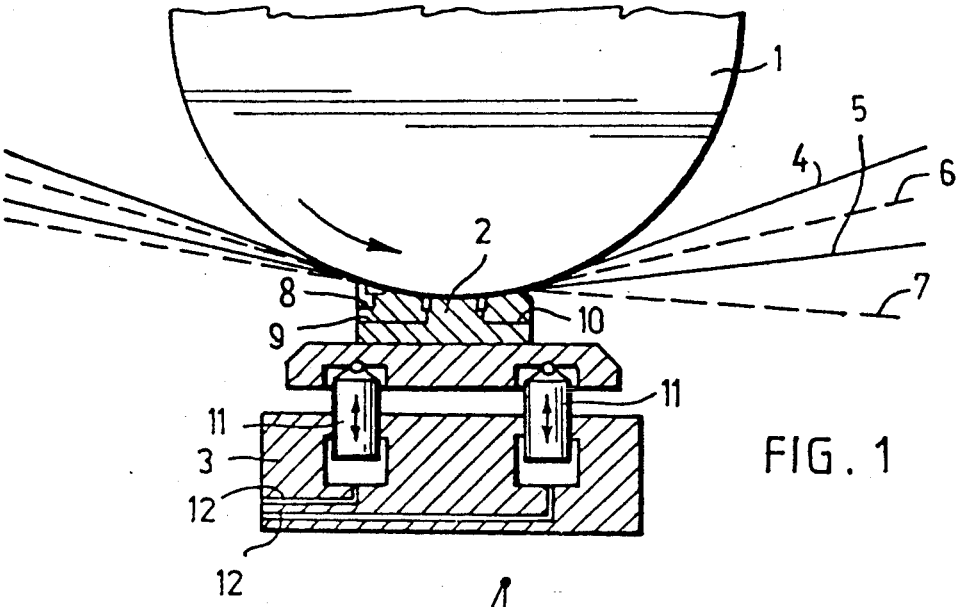
FIG. 1 illustrates schematically a shoe press of the invention.

FIG. 1 shows a press comprising a counter press roll 1 and a press shoe 2 which is positioned against the roll and rests on a base 3. Felts 4 and 5 extend between the roll 1 and the press shoe 2, and a web 6 to be dried is transported between the felts. Further, a slide band 7 is provided between the lower felt 5 and the press shoe 2. The band, which is lubricated by a lubricant, slides along the surface of the press shoe 2. The lubricant is introduced to the front edge of the press shoe 2 through a conduit 8 and to the central area of the band through conduits 9 and 10. The base 3 comprises press pistons 11 below which pressurized medium can be introduced through conduits 12 to load the press shoe 2. The structure and operation of the press are known per se, and will not be described more closely herein.

Figure 2:
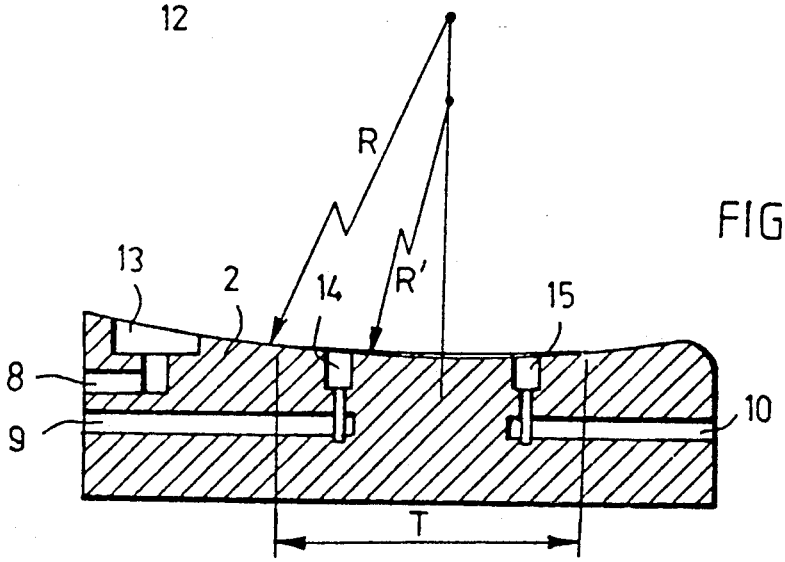
FIG. 2 is a schematic cross-sectional view of the press shoe of the press of FIG. 1.

FIG. 2 is a schematic cross-sectional view of the press shoe of FIG. 1 on an enlarged scale. The roll-contacting surface of the press shoe 2 has a radius of curvature R, that is, the curvature of the surface is such that the press shoe 2 can operate hydrodynamically. For this purpose, a groove 13 communicating with the lubricant introduction conduit 8 is provided in the front portion of the shoe 2. The lubrication liquid is fed into the groove, from which it is passed between the press shoe 2 and the slide band 7 by the action of the band 7 sliding along the surface of the press shoe 2, a thin lubrication film being thus formed on the band. The lubricant fed into the groove 13 through the conduit 8 has a low pressure such that it is merely able to pass the lubricant between the band 7 and the shoe so that a hydrodynamic lubrication is achieved when the band 7 moves. According to the invention, a pocket area formed by a shallow pocket is formed on the surface of the press shoe 2 over a length indicated with the letter T. The length of the pocket, T, in the direction of travel of the fibre web is approximately 40–60% of the length of the press zone. The average depth of the pockets should not exceed 0.75mm. In FIG. 2, the pocket is a pocket-like recess formed in the surface of the shoe 2 with a radius of curvature R' shorter than the normal radius of curvature R of the surface. In this particular case, the recess starts from the surface of the shoe 2 and ends in the surface of the shoe 2 with a clear point of discontinuity. To introduce lubrication liquid and, if required, pressurized lubrication liquid into the pocket, narrow deep grooves 14 and 15 are formed in the area of the pocket in its front and back portion, respectively. The lubricant can be fed into the grooves at different pressures through the conduits 9 and 10.

Figure 3:
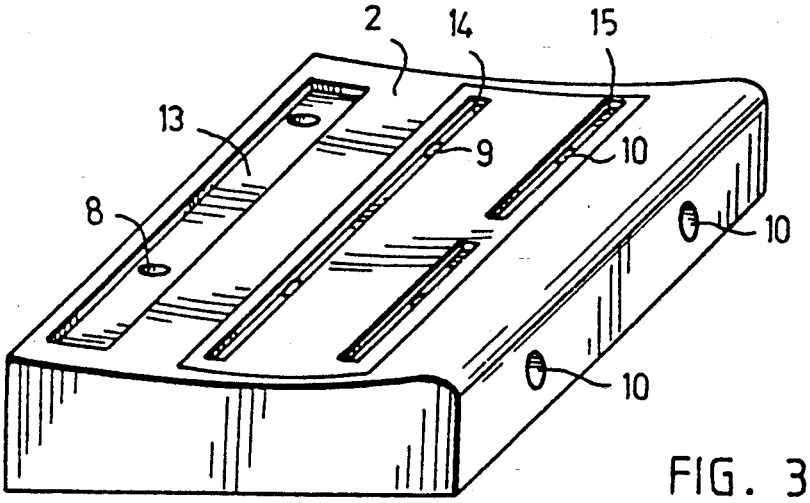
FIG. 3 is a perspective view of the press shoe of FIGS. 1 and 2.

FIG. 3 is a perspective view of the press shoe of the invention. As appears from the figure, the pocket area T formed in the surface of the press shoe 2 is surrounded by an edging having the normal radius of curvature of the surface of the press shoe 2. It further appears that the lubricant introduction grooves 14 and 15 are positioned within the pocket area, and that the grooves may extend nearly over the entire pocket area or there may be several shorter grooves in succession.

Figure 4:
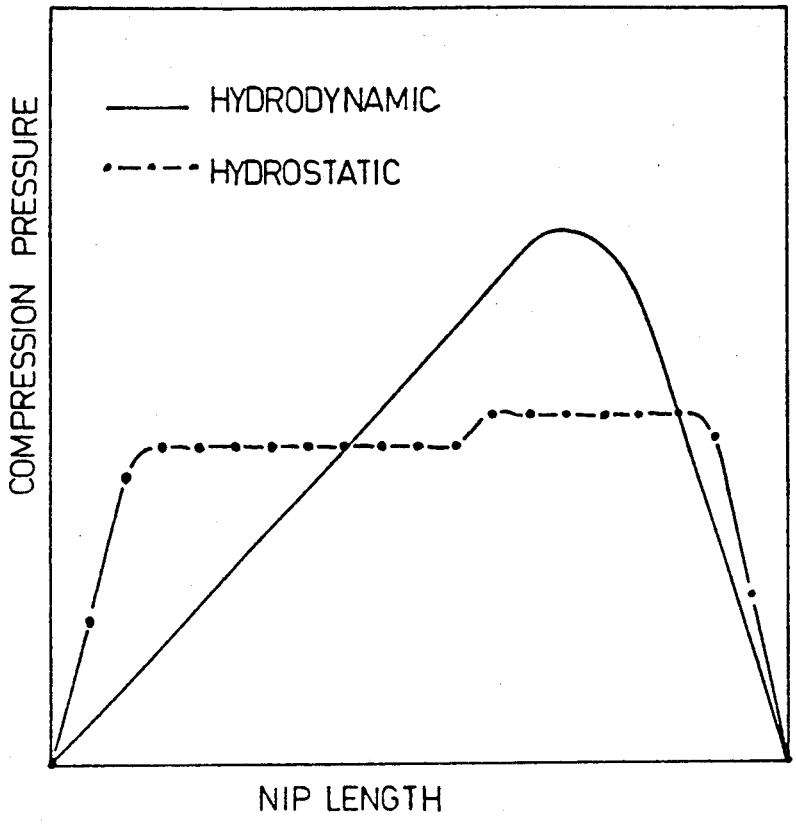
FIG. 4 illustrates the distribution of compression pressure in a hydrodynamic and a hydrostatic press.

The distribution of hydrodynamic compression pressure shown in FIG. 4 is a pressure distribution typical of the solution disclosed in U.S. Pat. No. 4,518,460, where the pressure increases evenly to its maximum and decreases then gradually. The hydrostatic compression pressure distribution is typical of the solution of U.S. Pat. No. 4,570,314, where the pressure is even within the area of the pockets.

Figure 5:
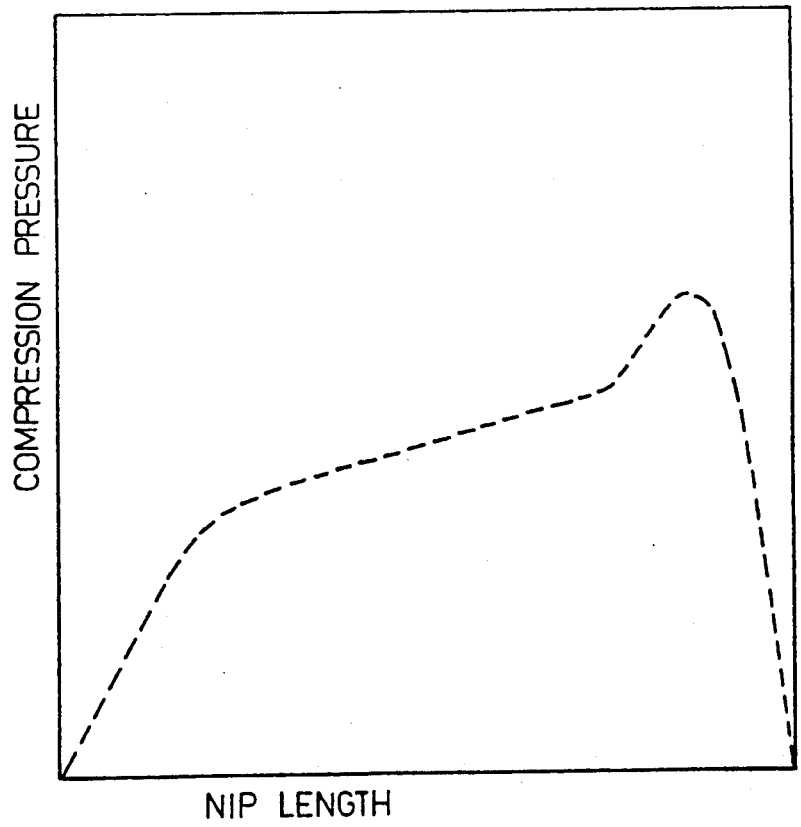
FIG. 5 illustrates the distribution of compression pressure in the press of the invention.

FIG. 5 illustrates the compression pressure distribution in the press with extended nip according to the invention, where the pressure is substantially on the increase throughout the press zone. As distinct from the hydrodynamic solution, the pressure drop on the delivery side is substantially more abrupt.

Figure 6:
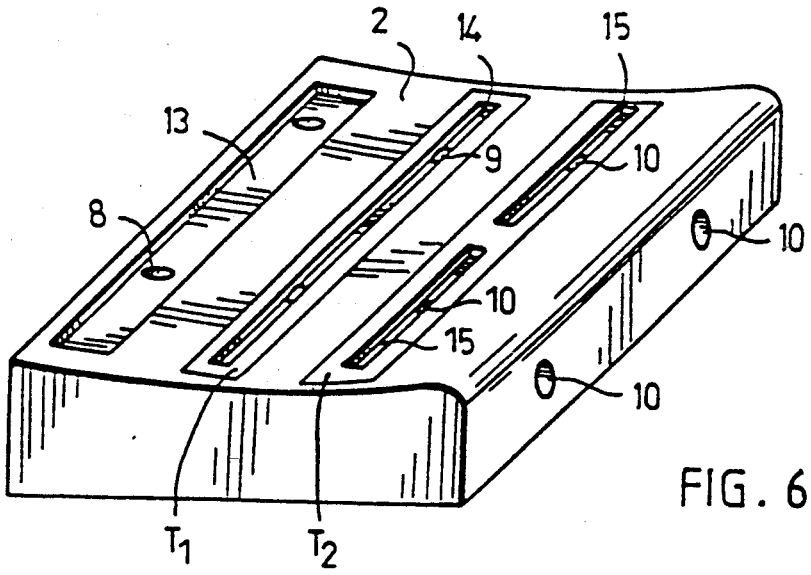
FIG. 6 illustrates schematically a shoe press according to another embodiment of the invention.
Figure 7:
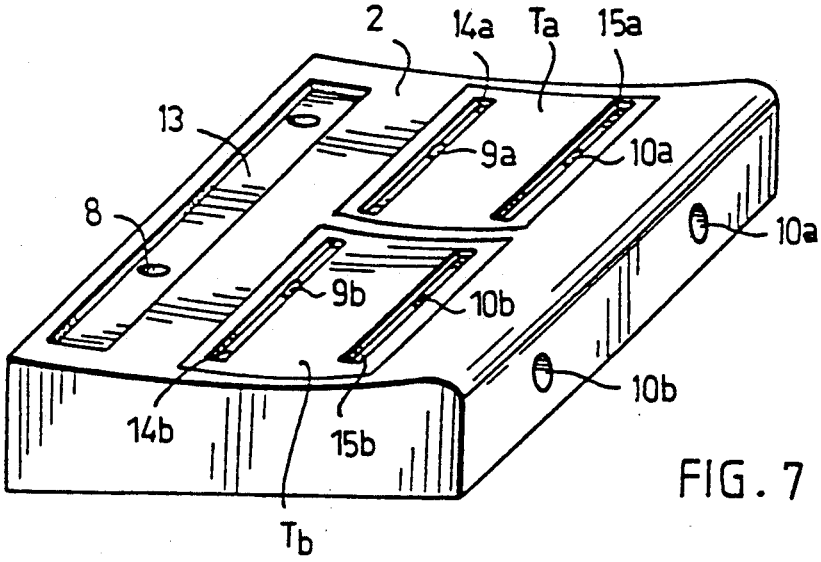
FIG. 7 illustrates schematically a shoe press according to another embodiment of the invention.
Figure 8:
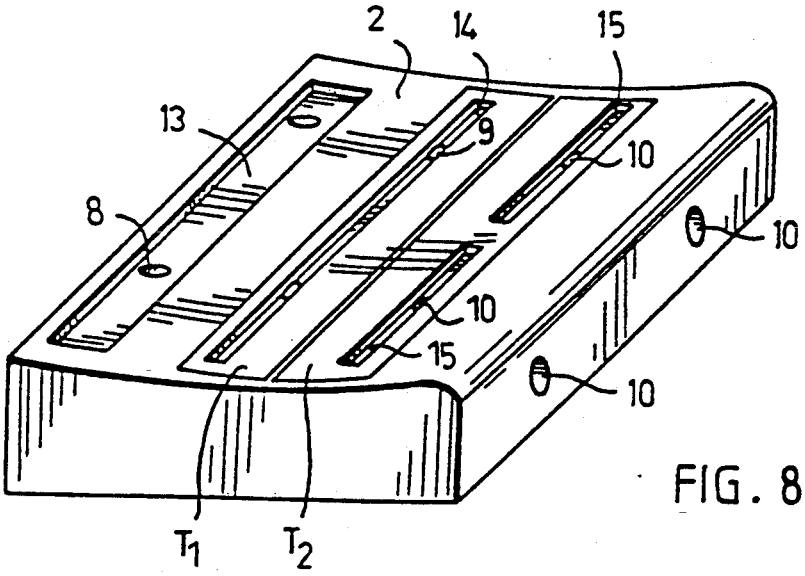
FIG. 8 illustrates schematically a shoe press according to another embodiment of the invention.

FIGS. 6-8 illustrate alternative embodiments of the invention in which the pocket area is formed by at least two pockets. As illustrated in FIGS. 6 and 8, pockets $T_1$ and $T_2$ can be positioned successively in the direction of travel of the fibre or in the direction of the press roll. Alternatively, as shown in FIG. 7, pockets $T_a$ and $T_b$ can be positioned substantially side by side to thereby by form an essentially continuous pocket area.

It is possible to feed the lubricant into the grooves 14 and 15 in the front and back edges of the pocket area at different pressures. By increasing the pressure of the lubricant to be fed into the groove 15, the smoothly rising pressure pattern can be maintained even at lower web speeds due to the hydrodynamic effect created by the band 7 and the pressure difference of the lubricant.

When the press shoe 2 in the press of the invention operates at its design speed, its bearing capacity consists mainly of the hydrodynamic effect, that is, the press operates at a low lubricant supply power. When the running speed is below the design speed, or a greater pressing power is required from the press, the required increase in the pressing capacity is obtained hydrostatically by feeding pressurized lubricant into the pocket area T. The lubrication film is thereby stiffer than in hydrodynamic lubrication, and the decrease in the thickness of the lubrication film caused by an increase in load or a reduction in speed is smaller. By selecting the lowest possible viscosity of the lubricant on the basis of the design speed and the load, a considerably lower total consumption of power is achieved as compared with the shoe press solutions known from the prior art. The introduction of lubricant and the even distribution of pressure within the pocket area is based on the fact that when lubricant is fed under pressure, it spreads sufficiently easily over a wide area in the relatively deep grooves of the pocket area, the grooves being also relatively narrow with respect to the width of the pocket area. Further, as the lubricant introduction openings are positioned on the bottoms of the grooves the formation of the hydrodynamic bearing capacity will not be disturbed notably. The depth of the lubricant introduction grooves 14 and 15 is at least five times the average depth of the pocket area, and their width is no more than one tenth of the width of the pocket area. To enable a substantially hydrodynamic operation of the shoe, it is very important that the depth of the pockets in the pocket area is not too great. Therefore the average depth of the pockets in the pocket area should be no more than 0.75 mm, whereby the pressure over the width of the pocket, i.e., in the direction of travel of the web, will not be levelled out similarly as in prior art static press solutions, in which the depth of the pocket area is very great and in which the hydraulic pressure is substantially constant over the entire pocket area. As used in this text, the depth of the pocket area means the distance of its bottom from the imaginary continuous surface which the press shoe would have without the pocket recesses. In the press of the invention the hydrodynamic wedge effect is maintained in the pocket area so that the pressure rises substantially evenly, as is usual in the hydrodynamic shoe. As compared with the hydrodynamic shoe, the pocket area provides the further advantage that the maximum pressure is also shifted closer to the delivery edge of the press zone while the hydrodynamic bearing capacity is considerably increased by suitably shaping the pocket area. By using prior art solutions to shift the centre of gravity of the support forces of the shoe, the maximum pressure of the nip can be adjusted as desired, whereby it can be decreased, if necessary, without any need of decreasing the line load of the press. One such way of shifting the centre of gravity is disclosed in FI Patent 65103.

The invention has been described above and in the attached drawings by way of example, and it is in no way restricted to this example. Even though the shoe shown in the figures comprises a single pocket, it is possible to realize the press in such a way that the surface of the shoe comprises a pocket area formed by several pockets positioned adjacent to each other in succession in the transverse and/or longitudinal direction of the web. In all cases, it should be taken into account that the average depth of each individual pocket should not exceed 0.75 mm, as already mentioned above.

The bottom of the press shoe shown in FIGS. 1 to 3 is curved in shape, but it is also possible to use a rectangular shape and edges that protrude sharply from the surface, provided that the average depth does not exceed the above-mentioned value. Further, the pocket can be sharp-angled at one edge, while the other edge defines a wide angle, as shown in FIGS. 1 to 3.

We claim:

1. A press with extended press zone in a paper machine for dewatering a wet fibre web, comprising a rotating press roll and at least one press shoe extending in the axial direction of the press roll, said press shoe bearing on the press roll;

a liquid-impermeable slide band having a direction of travel and sliding along the surface of the press shoe between the press shoe and the press roll in the direction of travel of the fibre web;

first lubricating means for introducing lubricant between the slide band and the press shoe at an entry edge of the press;

at least one press felt for passing the fibre web through the press between the press roll and the slide band and for receiving water from the fibre web;

a hydrodynamic pocket area in an upper surface of the press shoe facing the slide band having at least substantially the same width as the fibre web and being narrower than the extended press zone in the direction of travel of the band, said hydrodynamic pocket area comprising at least one pocket formed in the surface of the press shoe as a recess;

second lubricating means including at least one lubrication conduit for introducing pressurized lubricant to the hydrodynamic pocket area;

pocket means for increasing the pressure of the pressurized lubricant in the hydrodynamic pocket area between the press shoe and the slide band in the direction of travel of the fibre web, said pocket means comprising said at least one pocket having a depth such that the press operates substantially hydrodynamically; and said at least one pocket having a lubrication introduction area communicating with said at least one lubrication conduit, the lubrication introduction area formed by at least one lubrication introduction groove having a depth greater than the depth of said at least one pocket and extending in the axial direction of the roll.

2. A press according to claim 1, wherein the average depth of each pocket in the pocket area is no more than approximately 0.75 mm.

3. A press according to claim 1, wherein said at least one pocket is only one pocket the length of which in the direction of travel of the fibre web is 40 to 60% of the length of the press zone.

4. A press according to claim 1, wherein the pocket area is formed by at least two pockets positioned successively in the direction of travel of the fibre.

5. A press according to claim 4, wherein the pockets are positioned substantially side by side to form a continuous pocket area.

6. A press according to claim 1, wherein the pocket area is formed by at least two pockets positioned successively in the axial direction of the press roll with their ends close to each other.

7. A press according to claim 1, wherein said at least one lubrication conduit introduces lubricant into each pocket at a front edge of the pocket in the direction of travel of the fibre web substantially over the entire width of each pocket.

8. A press according to claim 7, wherein the width of each groove is no more than one tenth of the width of the pocket area and the depth is at least five times an average depth of the pocket area.

9. A press according to claim 8, wherein said at least one lubrication conduit includes two lubrication conduits for introducing pressurized lubricant into at least two portions of the pocket area positioned successively in the direction of travel of the fibre web.

10. A press according to claim 1, wherein a latter edge of said at least one pocket in the direction of travel of the fibre web becomes lower in a wedge-like manner in the direction of travel of the web.

11. A press with extended press zone in a paper machine for dewatering a wet fibre web, comprising a rotating press roll and at least one press shoe extending in the axial direction of the press roll, said press shoe bearing on the press roll;

a liquid-impermeable slide band having a direction of travel and sliding along the surface of the press shoe between the press shoe and the press roll in the direction of travel of the fibre web;

means for introducing lubricant between the slide band and the press shoe at an entry edge of the press; and at least one press felt for passing the fibre web through the press between the press roll and the slide band and for receiving water from the fibre web;

a pocket area in a surface of the press shoe facing the slide band having at least substantially the same width as the fibre web and being narrower than the extended press zone in the direction of travel of the band, said pocket area comprising at least one pocket having a depth formed in the surface of the press shoe as a recess;

at least one lubrication conduit for introducing pressurized lubricant to the pocket area; and said at least one pocket having a lubrication introduction area communicating with said at least one lubrication conduit and formed by at least one groove extending in the axial direction of the roll;

wherein the average depth of said at least one pocket is no more than 0.75 mm. in the pocket area, such that the press operates substantially hydrodynamically above a predetermined web speed.

12. A press according to claim 11, wherein said at least one pocket includes only one pocket the length of which in the direction of travel of the fibre web is 40 to 60% of the length of the press zone.

13. A press according to claim 11 wherein the pocket area is formed by at least two pockets positioned successively in the diretion of travel of the fibre.

14. A press according to claim 13 wherein said at least two pockets are positioned substantially side by side to form a continuous pocket area.

15. A press according to claim 11 wherein the pocket area is formed by at least two pockets positioned successively in the axial direction of the press roll with their ends close to each other.

16. A press according to claim 11, wherein said at least one lubrication conduit introduces lubricant into each pocket at a front edge of the pocket in the direction of travel of the fibre web substantially over the entire width of each pocket.

17. A press according to claim 16, wherein the width of each groove is no more than one tenth of the width of the pocket area and the depth is at least five times an average depth of the pocket area.

18. A press according to claim 17, wherein said at least one lubrication conduit includes two lubrication conduits for introducing pressurized lubricant into at least two portions of the pocket area positioned successively in the direction of travel of the fibre web.

19. A press according to claim 11, wherein a latter edge of said at least one pocket in the direction of travel of the fibre web becomes lower in a wedge-like manner in the direction of travel of the web.

* * * * *